US010301904B2

(12) United States Patent
Larsen et al.

(10) Patent No.: US 10,301,904 B2
(45) **Date of Patent: *May 28, 2019**

(54) METHOD FOR ISOLATION OF A PERMEABLE ZONE IN A SUBTERRANEAN WELL

(71) Applicant: Hydra Systems AS, Tananger (NO)

(72) Inventors: Arne Gunnar Larsen, Sandnes (NO); Roy Inge Jensen, Stavanger (NO); Patrick Andersen, Hafrsfjord (NO); Erlend Engelsgjerd, Tananger (NO); Markus Iuell, Tananger (NO); Arnt Olav Dahl, Randaberg (NO); Arnold Østvold, Stavanger (NO); Morten Myhre, Stavanger (NO)

(73) Assignee: Hydra Systems AS, Tananger (NO)

( * ) Notice: Subject to any disclaimer, the term of this patent is extended or adjusted under 35 U.S.C. 154(b) by 115 days.

This patent is subject to a terminal disclaimer.

(21) Appl. No.: 14/912,288

(22) PCT Filed: Aug. 26, 2014

(86) PCT No.: PCT/NO2014/050151
§ 371 (c)(1),
(2) Date: Feb. 16, 2016

(87) PCT Pub. No.: WO2015/034369
PCT Pub. Date: Mar. 12, 2015

(65) Prior Publication Data

US 2016/0201430 A1 Jul. 14, 2016

(30) Foreign Application Priority Data

Sep. 6, 2013 (NO) ..... 20131213

(51) Int. Cl.
*E21B 37/08* (2006.01)
*E21B 33/13* (2006.01)
(Continued)

(52) U.S. Cl.
CPC ..... *E21B 33/14* (2013.01); *E21B 33/13* (2013.01); *E21B 33/138* (2013.01); *E21B 37/00* (2013.01);
(Continued)

(58) Field of Classification Search
CPC ..... E21B 33/14; E21B 33/13; E21B 33/138; E21B 43/11; E21B 37/00; E21B 37/08; E21B 37/10; E21B 41/0078
See application file for complete search history.

(56) References Cited

U.S. PATENT DOCUMENTS 2,156,207 A 4/1939 Terrill
2,426,164 A 8/1947 Breukelman
(Continued)

FOREIGN PATENT DOCUMENTS

AU 2012211550 8/2013
CN 203008851 6/2013
(Continued)

OTHER PUBLICATIONS

International Search Report for International Application PCT/NO2014/050151 dated Dec. 8, 2014.
(Continued)

*Primary Examiner* — George S Gray
(74) *Attorney, Agent, or Firm* — Andrus Intellectual Property Law, LLP

(57) ABSTRACT

A method is for isolation of a permeable zone in a subterranean well, wherein the well is provided with a pipe body. The method comprises lowering a perforation tool into the pipe body; forming holes in the pipe body along a longitu-
(Continued)

dinal section; pumping a flushing fluid out through outlets in a flushing tool, into the pipe body and further out into an annulus; pumping a fluidized plugging material out through the flushing tool, into the pipe body and further out into the annulus; placing the fluidized plugging material along the longitudinal section so as to form a plug across the cross section of the well, whereby the plug fills the pipe body and the annulus; wherein at least one outlet in the flushing tool is angled non-perpendicularly relative to a longitudinal axis of the flushing tool, whereby a corresponding discharge jet also will be non-perpendicular to the longitudinal axis.

30 Claims, 11 Drawing Sheets

(51) Int. Cl.

| | |
|---|---|
| ***E21B 33/14*** | (2006.01) |
| ***E21B 41/00*** | (2006.01) |
| ***E21B 37/00*** | (2006.01) |
| ***E21B 43/11*** | (2006.01) |
| ***E21B 33/138*** | (2006.01) |

(52) U.S. Cl.
CPC ..... *E21B 37/08* (2013.01); *E21B 43/11* (2013.01); *E21B 41/0078* (2013.01)

(56) References Cited

U.S. PATENT DOCUMENTS 2,512,801 A 6/1950 Kinney et al.
2,591,807 A 4/1952 Greene
2,998,721 A 9/1961 Gawlik
3,064,734 A * 11/1962 Toelke ..... E21B 33/134 166/117
3,811,499 A 5/1974 Hutchison
3,850,241 A * 11/1974 Hutchinson ..... E21B 21/00 166/222
3,958,641 A 5/1976 Dill
4,019,576 A * 4/1977 Finch ..... E21B 43/12 166/250.03
4,040,482 A 8/1977 Vann
4,083,406 A 4/1978 Metz
4,088,191 A 5/1978 Hutchison
4,279,306 A 7/1981 Weitz
4,372,384 A 2/1983 Kinney
4,484,625 A 11/1984 Barbee, Jr.
4,531,583 A 7/1985 Revett
4,564,226 A 1/1986 Doherty, Jr.
4,589,490 A 5/1986 Darr et al.
4,688,640 A * 8/1987 Pritchard, Jr. ..... E21B 29/12 166/297
4,756,371 A 7/1988 Brieger
4,759,408 A 7/1988 Buchanan
4,889,187 A 12/1989 Terrell et al.
4,899,821 A * 2/1990 Casida ..... E21B 34/12 166/222
5,022,148 A 6/1991 Feldstein et al.
5,111,885 A 5/1992 Umphries
5,178,219 A * 1/1993 Striech ..... E21B 33/124 166/127
5,277,251 A 1/1994 Blount et al.
5,284,207 A 2/1994 Bittleson et al.
5,301,760 A 4/1994 Graham
5,320,174 A 6/1994 Terrell
5,372,198 A 12/1994 North et al.
5,377,757 A * 1/1995 Ng ..... C09K 8/502 166/277
5,381,631 A 1/1995 Raghavan et al.
5,402,850 A 4/1995 Lalande et al.
5,423,387 A 6/1995 Lynde
5,431,219 A 7/1995 Leising et al.
5,435,400 A 7/1995 Smith
5,472,052 A 12/1995 Head
5,474,130 A * 12/1995 Davis ..... E21B 37/08 166/222
5,484,018 A 1/1996 Cavender et al.
5,526,888 A 6/1996 Gazewood
5,564,500 A 10/1996 Rogers et al.
5,584,350 A 12/1996 Schnitker et al.
5,634,984 A * 6/1997 Van Slyke ..... B09C 1/025 134/26
5,791,417 A 8/1998 Haugen et al.
5,924,489 A 7/1999 Hatcher
6,155,343 A 12/2000 Nazzal et al.
6,206,100 B1 3/2001 George et al.
6,302,201 B1 * 10/2001 Elliott ..... E21B 17/1007 15/104.05
6,533,040 B2 3/2003 Gondouin
6,564,868 B1 5/2003 Ferguson et al.
6,828,531 B2 12/2004 Spencer
7,168,491 B2 1/2007 Malone et al.
8,020,619 B1 9/2011 Robertson et al.
8,312,921 B2 11/2012 Gambier et al.
8,336,612 B2 12/2012 Robertson
8,584,756 B1 11/2013 Barlow
9,010,425 B2 * 4/2015 Larsen ..... E21B 33/13 166/285
9,416,636 B2 8/2016 Myhre et al.
9,670,730 B2 6/2017 Larsen et al.
9,695,671 B2 7/2017 Myhre et al.
9,702,216 B2 7/2017 Larsen et al.
9,909,378 B2 3/2018 Myhre et al.
10,180,043 B2 1/2019 Myhre et al.
2001/0050172 A1 12/2001 Tolman et al.
2002/0023754 A1 2/2002 Buytaert
2002/0162657 A1 11/2002 Tumlin et al.
2004/0089450 A1 5/2004 Slade et al.
2004/0244992 A1 12/2004 Carter et al.
2005/0061503 A1 3/2005 Misselbrook et al.
2005/0067162 A1 3/2005 Gjedrem
2005/0121232 A1 6/2005 Rudd et al.
2006/0048940 A1 3/2006 Hromas
2006/0076137 A1 4/2006 Malone et al.
2006/0219441 A1 10/2006 Telfer
2008/0314591 A1 12/2008 Hales et al.
2009/0014177 A1 1/2009 Hilleary et al.
2009/0032257 A1 2/2009 Rayssiguier et al.
2009/0294127 A1 12/2009 Krueger et al.
2010/0025036 A1 2/2010 Gambier et al.
2010/0326665 A1 12/2010 Redlinger et al.
2011/0203809 A1 8/2011 Knobloch, Jr. et al.
2012/0006547 A1 1/2012 Robertson et al.
2012/0186817 A1 7/2012 Gibson et al.
2012/0279706 A1 11/2012 Solversen et al.
2012/0305251 A1 12/2012 Solversen et al.
2013/0192830 A1 * 8/2013 Watson ..... E21B 43/114 166/298
2014/0033885 A1 2/2014 Fuhst et al.
2014/0326470 A1 11/2014 Tinnen
2014/0367102 A1 12/2014 Larsen et al.
2015/0007991 A1 1/2015 Larsen et al.
2015/0021025 A1 * 1/2015 Myhre ..... E21B 33/13 166/285
2015/0027705 A1 * 1/2015 Larsen ..... E21B 33/13 166/285
2015/0053405 A1 * 2/2015 Bakken ..... E21B 37/08 166/285
2016/0201430 A1 7/2016 Larsen et al.

FOREIGN PATENT DOCUMENTS

EP 0690201 1/1996
EP 2006486 12/2008
GB 258808 9/1926
GB 2275282 8/1994
GB 2288350 10/1995
GB 2414492 11/2005
GB 2484166 4/2012
NO 20111641 11/2011
NO 20111641 7/2012

(56) References Cited

FOREIGN PATENT DOCUMENTS

| | | | | |
|---|---|---|---|---|
| NO | 20120077 | | 9/2012 | |
| NO | 20120099 | | 9/2012 | |
| NO | 20120277 | | 9/2013 | |
| WO | 9957409 | | 11/1999 | |
| WO | 0070183 | | 11/2000 | |
| WO | 0125594 | | 4/2001 | |
| WO | 02081861 | | 10/2002 | |
| WO | 2010060620 | | 6/2010 | |
| WO | 2011074981 | | 6/2011 | |
| WO | 2012096580 | | 7/2012 | |
| WO | 2012/105852 | | 8/2012 | |
| WO | 2012105852 | | 8/2012 | |
| WO | 2012128644 | | 9/2012 | |
| WO | 2013115652 | | 8/2013 | |
| WO | 2013122480 | | 8/2013 | |
| WO | WO-2013122480 | A1 * | 8/2013 | ..... E21B 33/14 |
| WO | 2013133719 | | 9/2013 | |

OTHER PUBLICATIONS

Written Opinion for International Application PCT/NO2014/050151 dated Dec. 8, 2014.

International Search Report and Written Opinion for PCT/NO2013/050045 dated Jun. 20, 2013.

HydraArchimedes, XP055167728, Feb. 5, 2012.

International Search Report and Written Opinion for PCT/NO2013/050045 dated Jun. 26, 2013.

Ferg et al: "Novel Approach to More Effective Plug and Abandonment Cementing Techniques", SPE Arctic and Extreme Environments Conference and Exhibition, dated Oct. 18, 2011, pp. 1-13, XP055167744, Moscow, Russia.

Larsen: "Hydrawash(TM)—a New Approach to Get Cement Behind Casing Without Milling", P&A Forum Workshop, dated Jun. 9, 2011, XP055167754, Sola, Norway.

* cited by examiner

METHOD FOR ISOLATION OF A PERMEABLE ZONE IN A SUBTERRANEAN WELL

FIELD

The invention concerns a method for isolation of a permeable zone in a subterranean well, for example in a petroleum well, water well or geothermal well. Moreover, the the method may be used in any type of subterranean well, including a production well, injection well, deviation well, horizontal well, etc.

More specifically, the invention concerns a method wherein a plug is established along a longitudinal section of a well, and substantially across a complete cross section of the longitudinal section, thereby preventing undesired fluid flow to or from a permeable zone in the well.

BACKGROUND

In, for example, a subterranean petroleum well, isolation of a permeable zone, or isolation between permeable and potential separate zones in the well, may prove essential to be able to control and optimize the course of production from the well. In the process of draining a permeable reservoir and/or weakening existing barriers for isolation between various reservoir zones, fluid streams within the reservoir may change. Such changes may arise by virtue of changing the composition of fluid components in the production stream and/or by virtue of the production stream decreasing or, at worst, ceasing. Further, such changes may arise when a production well extends through a subterranean reservoir and produces oil from an upper oil zone in the reservoir, whereas a lower zone of the reservoir contains water, also referred to as formation water. Usually, the oil will flow into the tubular production string of the well via well perforations formed within the oil zone. As the well production continues and the reservoir is drained for oil, a separating surface between underlying water and overlying oil in the reservoir will move gradually upward within the reservoir. Oftentimes, such a separating surface is referred to as an oil-water contact. Finally, the separating surface will come into contact with, hence in flow communication with, said well perforations, which define the well's influx region from the reservoir. Thereby, water from the reservoir will start to penetrate into the tubular production string via the well perforations and the influx region, which originally was formed exclusively within the oil zone of the reservoir. Thus, an increasingly larger proportion of water will be mixed together with oil during the course of production, whereby the production stream attains a gradually increasing water content during the course of production.

Moreover, if the production stream's pressure drop across the well perforations is of a certain magnitude, so-called water coning of said separating surface (oil-water contact) may arise around the influx region of the well. Such a water coning implies that the separating surface, due to said pressure drop, is lifted up locally around the well perforations. By so doing, water may flow into the well earlier than what would have been the case without such a water coning effect around the influx region of the well. Depending on the physical nature of the reservoir, especially in cases where the reservoir has a relatively low permeability, the oil-water contact of the reservoir may be comprised of a transition zone instead of a relatively sharp separating surface. In such a transition zone, as viewed from below and upward, a gradual transition from primarily water (high water saturation/low oil saturation) to primarily oil (low water saturation/high oil saturation) will exist, whereby the increasing influx of water during the course of production will be more gradual than the case would be when the oil-water contact is comprised of a relatively sharp separating surface.

Gas coning may also arise in a production well, wherein gas from an overlying gas zone may be caused, in a similar manner, to flow prematurely into the well at a particular pressure drop across the perforations of the well in the reservoir.

Both water coning and gas coning involve well-known production-related problems.

Further, a need may exist for isolating two or more permeable zones from each other in a well in order to prevent undesired fluid flow, so-called crossflow, in an annulus in the well. Such permeable zones may exist as adjoining zones, or as separate zones. Typically, said annulus will be an annulus between a pipe string, for example a tubular production string or a tubular injection pipe, and a surrounding borehole wall, i.e. surrounding rocks (formation) defining the borehole wall. In more rare cases, an outer and larger pipe string (pipe body) is used to define an outside of the annulus, whereby the annulus is located between an outer and inner pipe string in the well. Then, a further annulus will exist between the outer pipe string and the borehole wall of the well. Such an outer pipe string is typically used as reinforcement when a production/injection region of a well is located within weak and/or unstable reservoir rocks.

For example, preventing formation water from flowing from a permeable water zone and into a separate, permeable oil zone via such an annulus may be involved in context of such crossflow. It may also involve preventing the formation water from flowing, via the annulus, from the water zone and directly into a production stream from the oil zone. Conversely, it may involve preventing oil from flowing, via such an annulus, from a permeable oil zone and into a separate, permeable water zone. In an injection well, for example a well for injection of water and/or another fluid into a subterranean reservoir, a similar need may exist for isolating one or more permeable zones in the reservoir. By so doing, the injection stream may be conducted into a desired reservoir zone, and via well perforations located vis-à-vis the reservoir zone. As such, it may involve conducting an injection water stream into, or in vicinity of, a permeable oil zone in a subterranean reservoir, thereby increasing the reservoir pressure and forcing more oil out of the reservoir. In context of such a course of injection, it is also possible to construe that a need may arise for moving the injection stream to one or more other permeable zones in the reservoir, for example to zones in, or in vicinity of, the oil zone of the reservoir. As such, a need may arise for isolating previous injection zones and replacing these with new injection zones in the reservoir. In such cases, too, isolation of a permeable zone, or isolation between various permeable zones, may prove essential to be able to control and optimize the course of injection in such a well.

A well barrier, for example a cement barrier, the purpose of which is to prevent said undesired fluid flow (crossflow) in an annulus between various permeable zones in a well, may also be exposed to large strains, i.a. in the form of substantial pressure- and temperature differences. As such, the well barrier may be exposed to violent forces, including tensile-, compressive- and torsional forces. It is known that such strains over time may cause damage to such a well barrier, whereby the integrity of the barrier, hence its isolation effect, is destroyed completely or partially. Thus, such undesired fluid flow (crossflow) may arise in annuli behind, for example, casings, liners, production pipes and injection pipes. This may reduce or render impossible, in the worst case, further production from, or possibly injection into, a subterranean well.

SUMMARY

Accordingly, the object of the invention is to remedy or to reduce at least one of the disadvantages of the prior art, or at least to provide a useful alternative to the prior art.

The object is achieved by virtue of features disclosed in the following description and in the subsequent claims.

The invention concerns a method for isolation of a permeable zone in a subterranean well, wherein the well, at least in a portion where the isolation is to be carried out, is provided with a pipe body, wherein the method comprises the following steps:

(A) lowering a perforation tool into the pipe body onto a longitudinal section L1 of the well where the isolation is to be carried out;

(B) by means of the perforation tool, forming holes in the pipe body along the longitudinal section L1;

(C) by means of a flushing tool attached to a lower portion of a flow-through pipe string, and lowered into the pipe body onto the longitudinal section L1, pumping a flushing fluid down through the pipe string, out through at least one flow-through outlet in the flushing tool, into the pipe body and further out, via holes in the pipe body, into an annulus between an outside of the pipe body and a surrounding well body, thereby cleaning the annulus;

(D) pumping a fluidized plugging material down through the pipe string and out through the flushing tool, into the pipe body and further out into the annulus via holes in the pipe body;

(E) placing the fluidized plugging material along the longitudinal section L1 of the well, after which the plugging material forms a plug covering substantially a complete cross section T1 of the well, whereby the plug fills an inside of the pipe body and the annulus between the outside of the pipe body and the surrounding well body.

The distinctive characteristic of the method is that at least one of the at least one outlet in the flushing tool is angled non-perpendicularly relative to a longitudinal axis of the flushing tool, whereby a corresponding discharge jet from the flushing tool also will be non-perpendicular to the longitudinal axis of the flushing tool.

This configuration of the at least one outlet in the flushing tool ensures that a very effective flushing and cleaning of both the pipe body and the annulus outside the pipe body is achieved. This ensures good filling and good adhesion of the subsequent plugging material both in the pipe body and in the annulus.

Said pipe body may be comprised of a well pipe of a type known per se, for example of a casing or a liner. The pipe body may also be a part of a longer pipe string.

Further, said surrounding well body normally will be comprised of a borehole wall, i.e. of rocks (formation) defining the borehole wall, and then within the region of the well comprising said longitudinal section L1 to be isolated. This is discussed above.

In some cases, the surrounding well body may be comprised of another and larger pipe body, i.e. with a larger diameter, than the former pipe body, whereby a pipe-in-pipe constellation is present within this region of the well. This, too, is discussed above. In a production section or injection section of a well, however, it is relatively uncommon to use such an outer pipe body and an inner pipe body disposed in a pipe-in-pipe constellation in order to complete the well. If said longitudinal section L1 of the well comprises such a pipe-in-pipe constellation to be isolated, the perforation tool must form holes both through the inner and the outer pipe bodies along the longitudinal section L1 of the well.

Hereinafter, alle references to a pipe body will relate to the primary pipe body, which will be the inner pipe body in a pipe-in-pipe constellation.

Yet further, said (primary) pipe body may be comprised of a tubular production string in a production well.

Alternatively, this pipe body may be comprised of a tubular injection string in an injection well.

Moreover, the present perforation tool may comprise a perforation gun of a type known per se. Such a perforation gun comprises explosive charges arranged in a desired manner for allowing a corresponding arrangement of holes to be made through the pipe wall of the pipe body. Other types of perforation tools or cutting tools may also be used in the present method, for example a water cutting tool based on abrasive perforation.

Such perforation or cutting through the pipe wall of the pipe body is appropriate to ensure good circulation of a plugging material from the inside of the pipe body and out into the annulus (possibly the annuli) at the outside of the pipe body. Provided the number, distribution and shape of the holes in the pipe wall are not sufficient to ensure good circulation for subsequent flushing and plugging, the perforation step may be carried out in an undamaged/unperforated portion of the pipe body, or against an already perforated portion of the pipe body. A preferred distribution of holes in the pipe body may be in the order of 12 holes per foot arranged in a 135/45 degree phase within said longitudinal section L1.

Upon forming a plug covering substantially a complete cross section T1 of the well, it is possible to isolate one or more permeable zones in a subterranean well. This may prove advantageous in, for example, a case where it is desirable to isolate a particular permeable zone, or where it is desirable to prevent undesired fluid flow (crossflow) in an annulus behind a pipe body in the well, for example in an annulus behind a tubular production string or a tubular injection string. For example, the case may be that a previously set barrier element has lost its integrity, whereby undesired fluid production from one permeable formation/zone to another permeable formation/zone takes place via such an annulus. Thus, a plug covering the complete cross section will be able to isolate the formation/zone, which is producing the undesired fluid flow, from the other, receiving formation/zone in the well. Various such well situations are also described in further detail above.

With respect to the prior art, it is known to establish a well slug by means of a method and a washing tool as shown and described in Norwegian patent application No. 20111641 entitled "Method for combined cleaning and plugging in a well, washing tool for directional washing, and use of the washing tool". NO 20111641 corresponds to international publication WO 2012/096580 A1.

Unlike the washing tool according to NO 20111641 (and WO 2012/096580 A1), the present flushing tool is used both for flushing and plugging of the longitudinal section L1 of the well. In addition, the flushing tool is primarily intended for reuse and, further, may be readily modified for various well specific purposes.

Further, and before step (D), the present method may comprise disposing and anchoring a plug base in the pipe body, and below the longitudinal section L1 of the well. For example, the plug base may comprise a mechanical plug, and possible a packer element, of a type known per se.

If the longitudinal section L1 is located far from the bottom of the pipe body, it may be necessary to set such a plug base so as to form a base for the fluidized plugging material in the subsequent plugging operation, i.e. in steps (D) and (E) of the method. On the other side, if the longitudinal section L1 is located at a relatively short distance from the bottom of the pipe body, it may be unnecessary to set such a plug base in the pipe body. Instead, the fluidized plugging material is filled from the bottom of the pipe body and upward until the plugging material covers the longitudinal section L1 of the well.

Yet further, the flushing tool may comprise a first section for discharge of the flushing fluid, and a second section for discharge of the fluidized plugging material. Thereby, the first section may be arranged with an optimum configuration and size of outlets for optimum discharge of the flushing fluid, whereas the second section may be arranged with an optimum configuration and size of outlets for optimum discharge of the fluidized plugging material. In order to avoid potential setting and plugging of plugging material, outlets for the plugging material possibly may be larger than the outlets for the flushing fluid.

The flushing tool may also be formed with several outlets, wherein the outlets are angled within ±80° of a plane being perpendicular to the longitudinal axis of the flushing tool, whereby the discharge jets from the longitudinal axis of the flushing tool also are distributed within ±80° of said plane. This will prove particularly appropriate with respect to cleaning of the annulus (possibly the annuli) given, then, that it will be easier for the flushing fluid, having such angled discharge jets, to gain access to various places in the annulus, thus achieving an optimum flushing and cleaning effect in the annulus.

In this context, at least one of the at least one outlet in the flushing tool may be provided with a nozzle, for example a nozzle of a suitable size and/or shape. Thereby, several outlets in the flushing tool possibly may be of a particular size, whereas nozzles in the outlets may have different sizes and/or shapes, whereby the discharge jets from the nozzles may be different. By so doing, it is also easy to modify the flushing tool and its associated flushing effect in order to achieve the desired effect.

Yet further, step (C) of the method, i.e. the flushing step, may comprise rotating the pipe string whilst flushing, and/or moving the pipe string in a reciprocating motion whilst flushing. This may produce a very thorough cleaning on the inside and outside of the pipe body along the longitudinal section L1 of the well.

Further, the method may comprise adding an abrasive agent to the flushing fluid. Such an abrasive agent may comprise small particles of particulate mass, for example sand particles. Use of an abrasive agent in the flushing fluid may prove particularly appropriate if the annulus (possibly the annuli) outside the pipe body is completely or partially filled with, for example, cement residues, formation particles, precipitated drilling mud components and/or other casting materials or fluids. Such material may prove difficult to remove without abrasive agents present in the flushing fluid.

According to the method, an abrasive agent may thus be added to the flushing fluid in an amount corresponding to between 0.05 weight percent and 1.00 weight percent. In a particularly preferred embodiment, circa 0.1 weight percent of an abrasive agent, for example sand, may be added to the flushing fluid.

In a further embodiment of the method, the flushing fluid may be discharged from the at least one outlet of the flushing tool at a discharge velocity of at least 15 meters per second. Tests show that 15 meters per second is a limit value above which the flushing tool is able to clean sufficiently.

It is more advantageous for the flushing fluid to be discharged from the at least one outlet of the flushing tool at a discharge velocity of at least 50 meters per second. Said tests also have shown that the flushing is particularly effective when the flushing fluid has a discharge velocity of at least 50 meters per second.

Further, the flushing fluid possibly may be discharged from the at least one outlet of the flushing tool as a substantially rotation-free discharge jet. The advantage thereof is that there is no need, then, for nozzles that possibly may provide a rotational effect to the discharge jet, insofar as such nozzles usually require more space for support.

Moreover, the fluidized plugging material may comprise cement slurry, which constitutes the most common plugging material in most wells.

As an alternative or addition, the fluidized plugging material may comprise a fluidized particulate mass. A somewhat different use of a fluidized particulate mass in a well is described, among other places, in WO 01/25594 A1 and in WO 02/081861 A1.

Furthermore, the flushing fluid may comprise drilling mud. This will be a suitable flushing fluid given that drilling mud usually is readily available and also functions as a pressure barrier in a well.

Yet further, a displacement body may be used in the present method to further displace and distribute the fluidized plugging material in the pipe body and further out into the annulus. Such a displacement body is shown and described, among other places, in Norwegian patent application No. 20120099 entitled "Apparatus and method for positioning of a fluidized plugging material in an oil well or gas well", which corresponds to international publication WO 2012/128644 A2.

In a further embodiment, the method may also comprise, before step (A), the following steps:

connecting the perforation tool and the flushing tool into an assembly thereof; and connecting the assembly to said lower portion of the pipe string;

thereby carrying out the perforation steps (A, B) and the flushing step (C) in one and the same trip down into the well.

Obviously, this embodiment of the method saves on time and cost, which is of particularly great significance for well operations offshore.

In this context, a lower end portion of the flushing tool possibly may be releasably connected to the perforation tool; and wherein the perforation tool is separated from the flushing tool and is left in the well after step (B).

This may prove particularly appropriate provided it is possible to leave the perforation tool in the pipe body, and below the longitudinal section L1 of the well. This may prove appropriate to save on operational time and/or if the perforation tool is of a drillable material, for example aluminium or similar.

By comparison, a combined perforation- and washing tool is described in said NO 2011641, which corresponds to WO 2012/096580 A1. The perforation tool and the washing tool may be joined or individually releasable from an associated pipe string.

In an alternative embodiment, the method may also comprise, before step (C), the following steps:

lowering the perforation tool into the pipe body and forming said holes in the pipe body along the longitudinal section L1 of the well;

pulling the perforation tool out of the well; and attaching the flushing tool to the lower portion of the pipe string for subsequent execution of steps (C)-(E);

thereby carrying out the perforation steps (A, B) and the flushing step (C) in separate trips down into the well.

Such an embodiment of the method may prove necessary provided it is not possible to leave the perforation tool in the well, for example due to lack of space in the pipe body.

In context of the method, the longitudinal section L1 possibly may be located vis-à-vis a permeable reservoir zone, thereby forming the plug vis-à-vis the permeable reservoir zone. As such, the permeable reservoir zone may comprise, for example, an oil-water contact in a subterranean reservoir.

As an alternative, the longitudinal section L1 possibly may be located vis-à-vis a portion of the annulus where crossflow exists, thereby forming the plug vis-à-vis this crossflow portion of the annulus. For example, water from a water zone may thus be prevented from flowing into a separate oil zone via the annulus, or vice versa, or the water may be prevented from flowing into a production stream from the oil zone.

Further, the method may comprise, after step (E), a step of forming, by means of a perforation tool, at least one hole in the pipe body (i.e. through the wall of the pipe body) along a portion of the well located above the longitudinal section L1 where the plug has been set and covers substantially the complete cross section T1 of the well. This may prove necessary if, for example, existing production perforations are plugged up or closed off from the rest of the well in context of the isolation. Thus, for example, new perforations may be formed higher up in an oil zone in a reservoir after having isolated an underlying oil-water contact by means of such a plug.

As an alternative or addition, the method may comprise, after step (E), a step (F) of drilling out a central, through-going portion of the plug in the pipe body, whereby at least a cross-sectional section T3 of the plug remains in the annulus outside the pipe body. By so doing, the pipe body and the well are re-opened so as to establish contact with equipment and rocks located below the longitudinal section L1 and the plug.

In this context, the method may comprise, after step (F), a step of forming, by means of a perforation tool, at least one hole in the pipe body (i.e. through the wall of the pipe body) along a portion of the well located below the longitudinal section L1 where the plug has been set and drilled out. This, for example, may be desireable in a case where it is to be produced from, or injected into, a permeable well zone located below the plug.

BRIEF DESCRIPTION OF THE DRAWINGS

Hereinafter, two exemplary embodiments of the present method are described, wherein the embodiments are depicted in the accompanying drawings, where:

FIG. 1 thus shows, according to the first embodiment, a simplified, schematic vertical section through said production well;

FIG. 2 shows the well after having set a plug base in a production pipe in the well, and after having lowered a perforation tool onto a plugging region in the well located above the plug base;

FIG. 3 shows the well after the perforation tool has formed new perforations within the plugging region in the production pipe;

FIG. 4 shows, in larger scale and detail, the well after having lowered a flushing tool into the well and onto the plugging region, and whilst being in the process of flushing the production pipe and an external annulus via perforations in the production pipe;

FIG. 5 shows, in larger scale and detail, the well after the flushing tool has completed the flushing of the plugging region, and whilst the flushing tool is in the process of displacing and distributing cement slurry (fluidized plugging material) in the production pipe and out into the external annulus via perforations in the production pipe;

FIG. 6 shows the well after having set a cement plug in the plugging region, and across the complete cross section of the well;

FIG. 7 shows the well immediately after having drilled out a central, through-going portion of the cement plug by means of a drilling tool;

FIG. 8 shows the well after having removed the drilling tool from the well so as to leave a remaining cross-sectional section of the cement plug in the annulus outside the production pipe;

FIG. 9 shows the well after having formed new perforations in the production pipe below the plugging region and the remaining cross-sectional section of the cement plug;

FIG. 10 shows, according to the second embodiment, a simplified, schematic vertical section through said similar production well, but wherein water from a deeper level in the well flows in an undesirable manner in an annulus behind a production pipe and into a production stream from the well; and FIG. 11 shows the well after having formed and set a cement plug in a plugging region below the production stream, and across the complete cross section of the well, whereby the cement plug prevents water flow from the deeper level in the well and onto the production stream.

DETAILED DESCRIPTION OF THE DRAWINGS

Figure 1:
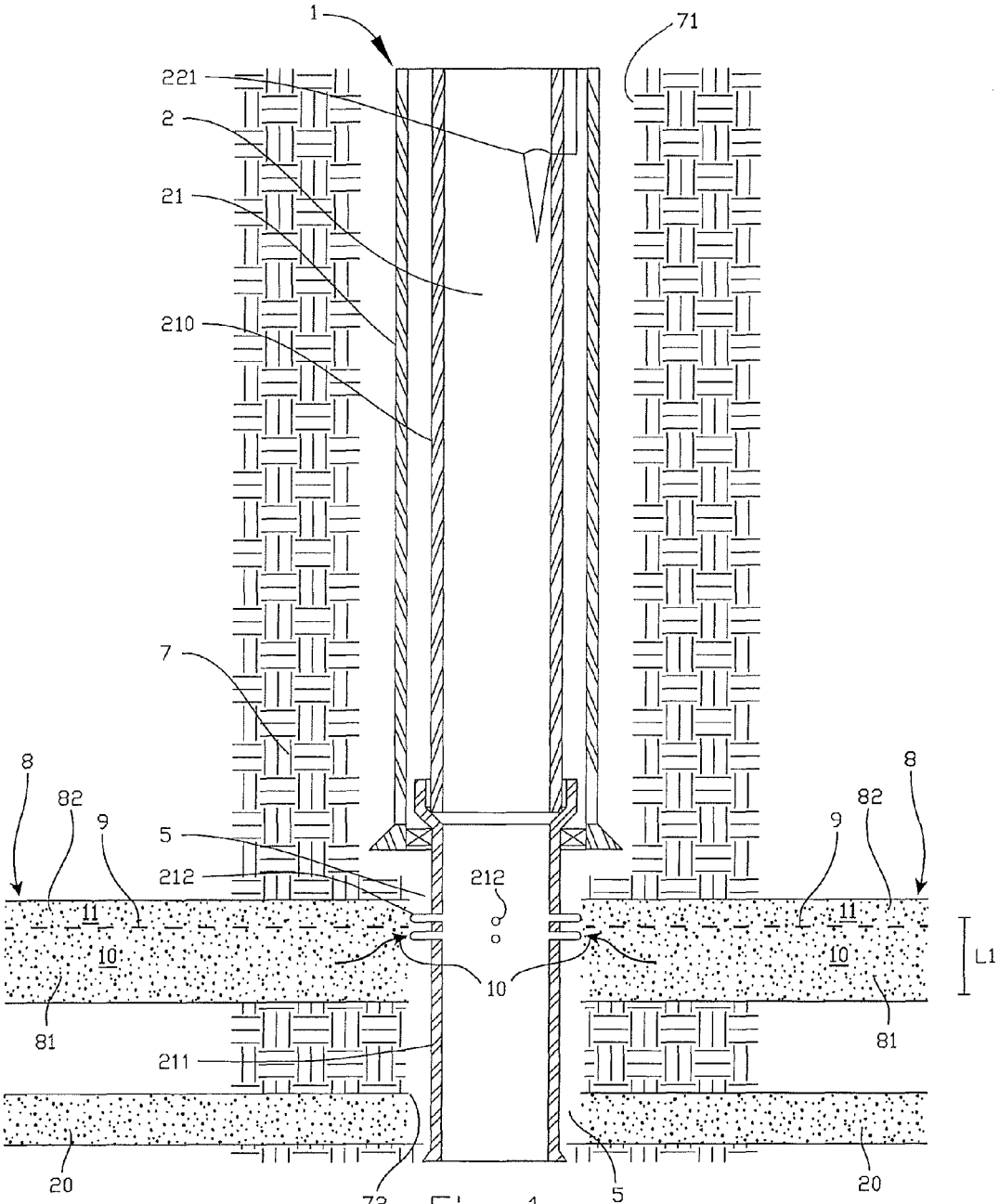
FIGS. 1-9 show, in a first embodiment, different stages of the method as used for isolation in one situation in a production well.

The Figures are schematic and merely show steps, details and equipment being essential to the understanding of the invention. Further, the Figures are distorted with respect to relative dimensions of elements and details shown in the Figures. The Figures are also somewhat simplified with respect to the shape and richness of detail of such elements and details. Elements not being central to the invention may also have been omitted from the Figures. Hereinafter, equal, equivalent or corresponding details in the Figures will be given substantially the same reference numerals.

Hereinafter, reference numeral 1 denotes a subterranean production well within which the present method is used. Well fluids and already established pressure barriers, which will be known to a skilled person, are not shown in the Figures.

FIG. 1 shows a casing 21 extending down into the production well 1 and forming a radial boundary between a well path 2 and surrounding rocks 7 defining a borehole wall 71 in this portion of the well 1. A pipe body 211, here in the form of a production pipe, is suspended from a lower portion of the casing 21 and extends further down into a producing portion of the well 1. The production pipe 211 is provided with perforations 212, which are formed vis-à-vis a subterranean reservoir 8, and which are in flow communication with the reservoir 8. Thereby, reservoir fluids may flow from the reservoir 8, through the perforations 212 and into the production pipe 211. Further, the production pipe 211 is connected to an overlying connection pipe 210. Collectively, the production pipe 211 and the connection pipe 210 constitute a tubular production string extending through the entire the well 1 and up to surface. In both exemplary embodiments, the tubular production string is formed so as to have one and the same inner diameter throughout the complete length thereof. A production valve 221 of a type known per se is also disposed in the connection pipe 210 for allowing the production stream to be closed off, if required.

Further, FIG. 1 shows a separating surface 9 (oil-water contact) between a permeable water zone 81 and an overlying, permeable oil zone 82. During the course of production, the separating surface 9 moves upward in the reservoir 8 (and possibly cones, as discussed above) until water 10 from the water zone 81 starts to flow into and through the perforations 212 so as to mix with oil 11 from the oil zone 82. In FIG. 1, such undesired water influx is shown with arrows pointing into and toward the perforations 212. Thus, the resulting production stream in the tubular production string 211, 210 will contain water 10 that gradually may replace, fully or partially, the influx of oil 11 into the production pipe 211. Obviously, this is an undesirable situation. FIG. 1 shows only perforations 212 as they appear at this stage of the course of production of the well 1, i.e. where the perforations 212 are located at an upper portion of the oil zone 82. As such, it is normal to form new perforations 212 higher up in the oil zone 82 as the oil zone 82 is drained for oil 11 and the separating surface 9 moves upward in the reservoir 8. In this context, a mechanical plug is oftentimes set in the production pipe 211, and immediately below the new perforations 212, in order to prevent influx of water 10 from deeper regions of the water zone 81. However, water 10 from such deeper regions of the water zone 81 may enter and mix with the production stream via an annulus 5 located between the production pipe 211 and a surrounding borehole wall 72 defining, among other things, the producing portion of the well 1. This is not shown in FIG. 1.

Figure 9:
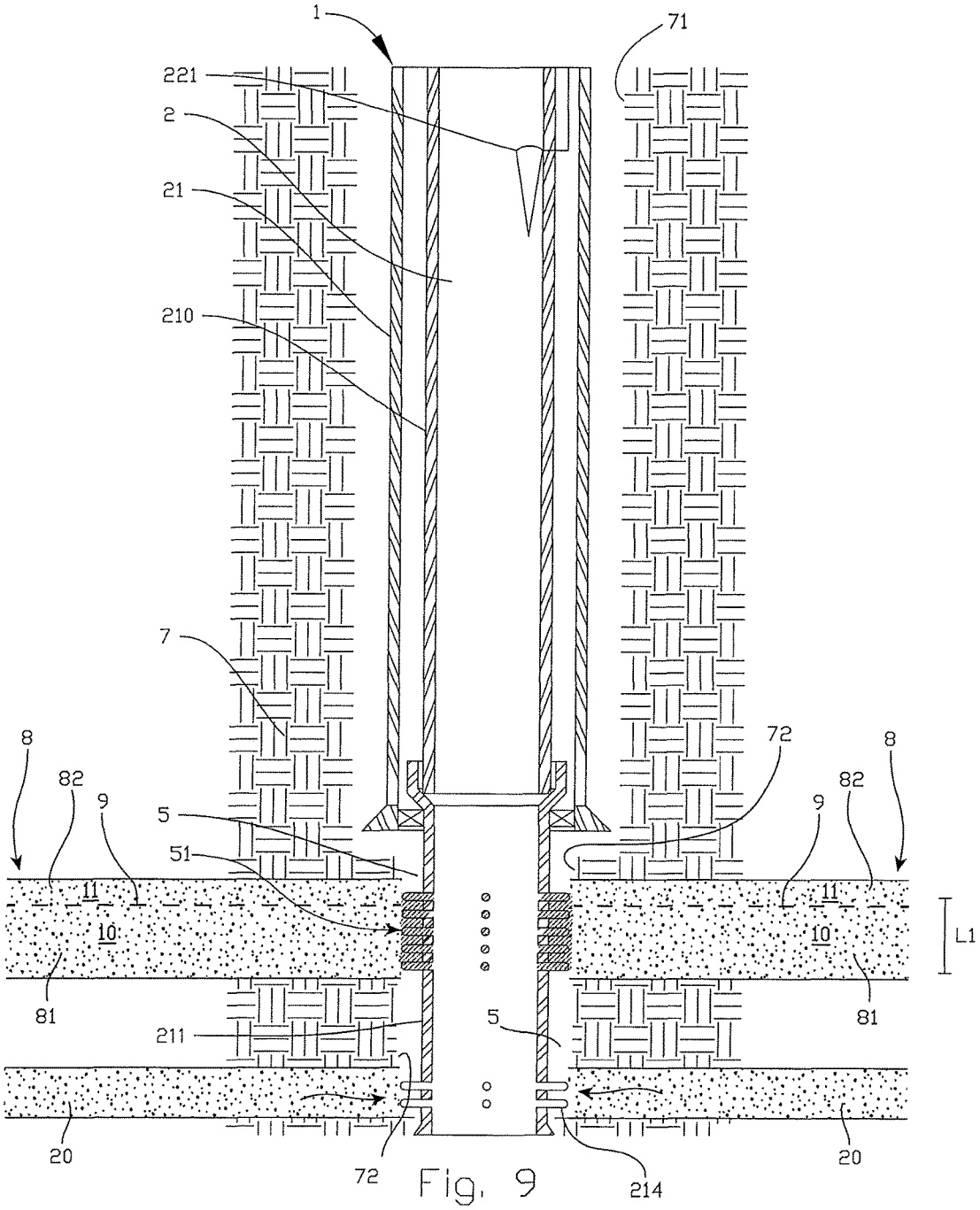

It is therefore desirable, in this embodiment, to remove, or at least to reduce, such undesired influx of water 10 into the production stream. This is achieved by isolating the entire reservoir 8 from the rest of the well 1. Subsequently, it is desirable to form new perforations 214 in the production pipe 211 vis-à-vis a separate, deeper oil reservoir 20 in the well 1, as shown in FIG. 9. The distance between the reservoirs 8 and 20 may be very large, commonly in the order of kilometers. After isolation of the reservoir 8 and access to the deeper oil reservoir 20, the well 1 may produce from the oil reservoir 20.

In this context, it is also mentioned that such new perforations 214, in an embodiment not shown, just as well may be formed in a separate petroleum reservoir located above the reservoir 8 in the well 1.

Figure 2:
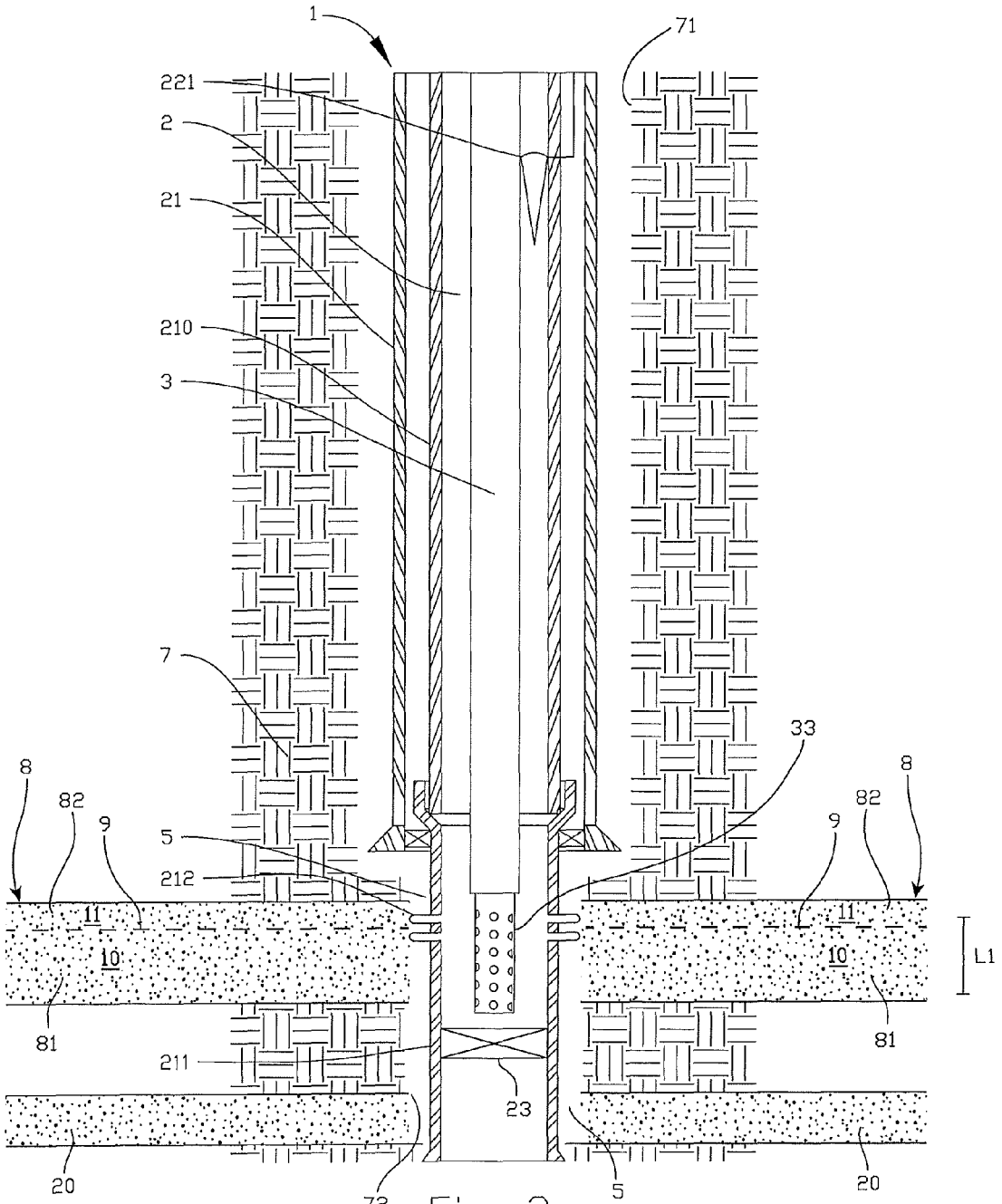
Figure 4:
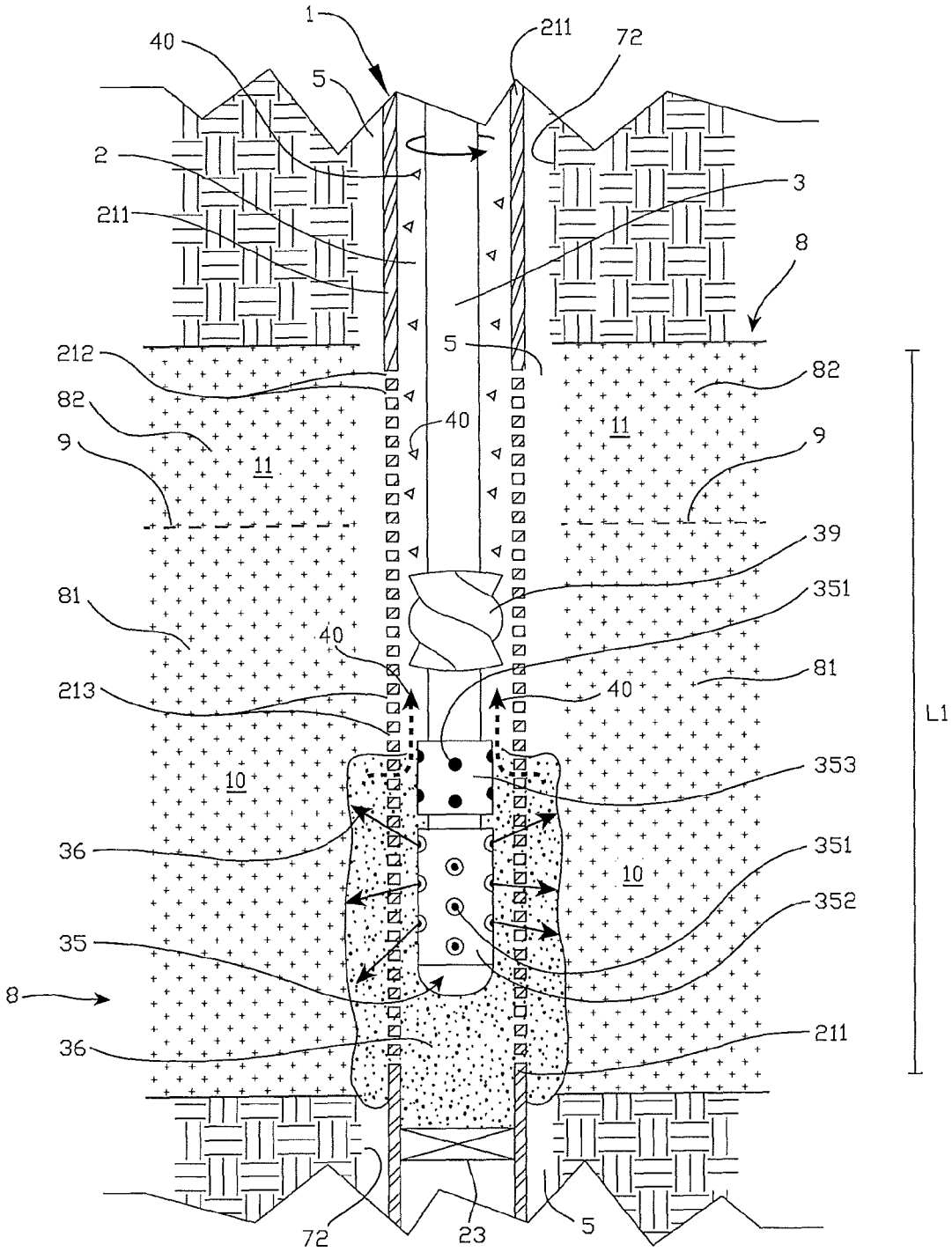

FIG. 2 shows the well 1 after having set a plug base 23, for example a mechanical plug, in the production pipe 211 below a longitudinal section L1 of the well 1 desired to be plugged, and after having lowered a perforation tool 33 into the production pipe 211 on a lower end of a pipe string 3. The perforation tool 33 is positioned above the plug base 23 and along the longitudinal section L1, which includes the existing perforations 212. The perforation tool 33 may be a perforation gun of a type known per se. The perforation tool 33 is used to form new perforations 213 in the production pipe 211, and immediately below the existing perforations 212. Both the existing and the new perforations 212, 213 are to be used during the subsequent washing and plugging, as shown in FIG. 4. However, in a case not shown, wherein the existing perforations 212 satisfy the requirements with respect to shape, positioning and density for allowing an effective flushing- and plugging operation to be carried out thereafter, it will not be necessary to form new perforations 213.

Figure 3:
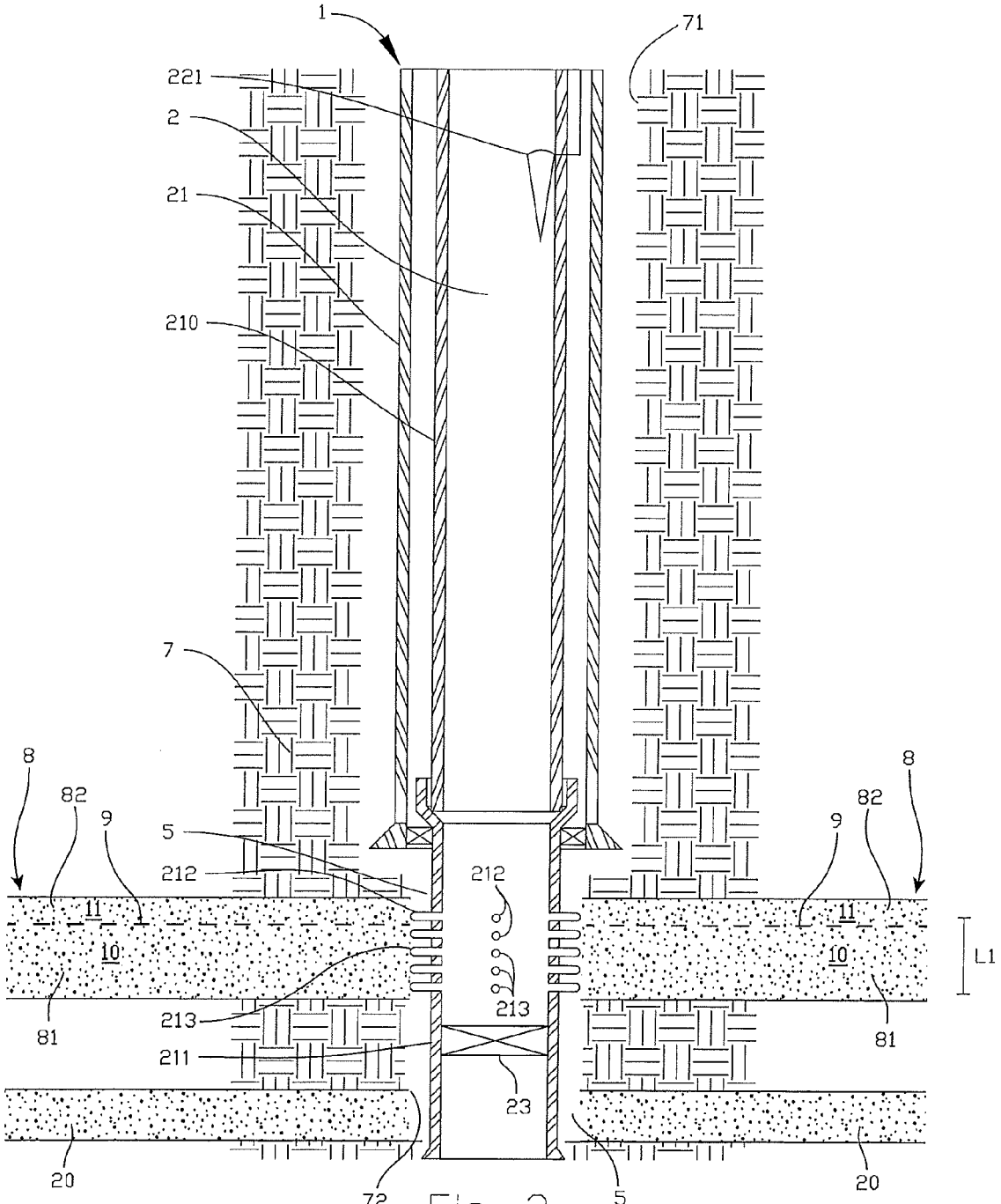

FIG. 3 shows the well 1 after the perforation tool 33 has formed new perforations 213 in the production pipe 211 within the longitudinal section L1 to be plugged, and after having pulled the pipe string 3 with the perforation tool 33 out of the well 1.

FIG. 4 shows the well 1 after having lowered a combined flushing- and plugging tool 35, hereinafter termed a flushing tool, into the production pipe 211 and onto the longitudinal section L1, and whilst the flushing tool 35 is in the process of flushing the production pipe 211 and the external annulus 5 via the perforations 212, 213 in the production pipe 211. In this exemplary embodiment of the method, perforation is carried out in one trip down into the well 1 (cf. FIG. 2), whereas flushing and plugging are carried out in a separate trip down into the well 1. However, perforation, flushing and plugging may be carried out in one and the same trip trip down into the well 1, which is not shown here.

FIG. 4 also shows a flushing fluid 36, for example drilling mud, being pumped down through the pipe string 3, out through several flow-through outlets 351 in the flushing tool 35, into the production pipe 211 and further out into the annulus 5 via perforations 212, 213 in the production pipe 211. By so doing, both the production pipe 211 and the annulus 5 are cleaned. The discharge jets of the flushing fluid 36 from the flushing tool 35, and its subsequent flow direction, is indicated with arrows in FIG. 4. The flushing fluid 36 discharges at high velocity from various outlets 351 in a first (and lower) section 352 of the flushing tool 35. Before initiating the discharge, a first ball (not shown) is dropped down through the pipe string 3 so as to seat in a first seat (not shown) disposed below the outlets 351 in the first section 352 of the flushing tool 35. This ensures that the flushing fluid 36 is forced out through these outlets 351. Further, the outlets 351 typically will be provided with nozzles in order to concentrate the discharge jets and achieve the desired concentration of the flushing fluid 36. The discharge jets from the outlets 351 possibly may be rotation-free. Also, the various outlets 351 are angled in such a manner that the discharge jets have dissimilar discharge angles relative to a plane being perpendicular to a longitudinal axis of the flushing tool 35. This is indicated in FIG. 4, too. The angled discharge jets render possible to gain access to, and clean effectively within, the annulus 5 between the production pipe 211 and the reservoir 8. FIG. 4 also shows liberated particles 40 flowing, together with the flushing fluid 36, upward in the production pipe 211 upon having been flushed and liberated in the annulus 5, subsequently flowing into the production pipe 211 via perforations 212, 213 therein. A curved arrow at an upper portion of the pipe string 3 indicates that the flushing tool 35 rotates along with the pipe string 3 whilst flushing. As an addition or alternative, the pipe string 3 may be moved in a reciprocating motion whilst flushing. Such motions ensure an even more thorough and more effective flushing and cleaning of the production pipe 211 and the annulus 5. The flushing also ensures better adhesion for a subsequent plugging material, which in this exemplary embodiment is comprised of cement slurry 37.

Figure 5:
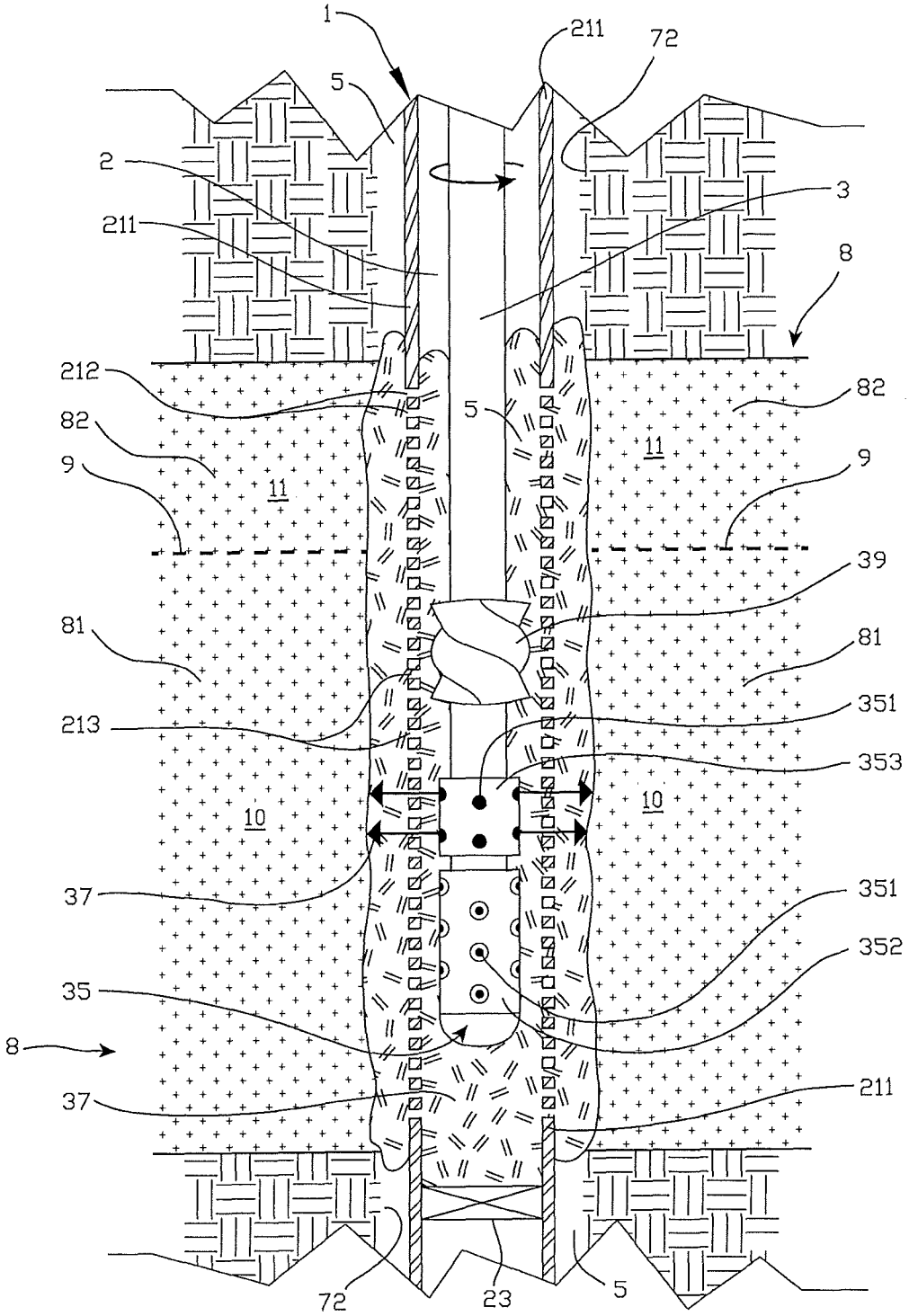

FIG. 5 shows, in a somewhat larger scale and detail, said cement slurry 37 when subsequently being pumped down through the pipe string 3, out through the flushing tool 35, into the production pipe 211 and further out into the annulus 5 via the perforations 212, 213 in the production pipe 212. By so doing, cement slurry 37 is placed above the plug base 23, and along the longitudinal section L1 of the well 1, as shown in FIG. 5. The cement slurry 37 is now discharging from various outlets 351 in a second (and upper) section 353 of the flushing tool 35. Before initiating the discharge, a second and larger ball (not shown) is dropped down through the pipe string 3 so as to seat in a second and larger seat (not shown) disposed immediately below the outlets 351 in the second section 353 of the flushing tool 35. This ensures that the cement slurry 37 is forced out through the outlets 351 in the second section 353 of the flushing tool 35. Activation by means of such balls constitutes prior art. Also in FIG. 5, a curved arrow at the upper portion of the pipe string 3 indicates that the flushing tool 35 rotates along with the pipe string 3 whilst pumping cement slurry 37. As an addition or alternative, the pipe string 3 may be moved in a reciprocating motion whilst pumping cement slurry 37. Such motions ensure that the cement slurry 37 is displaced out into the particular places in the production pipe 211 and further out into the annulus 5. In this exemplary embodiment, the pipe string 3 is also provided with a helical displacement body 39 being rotated and moved in the cement slurry 37 in the production pipe 211, during the pumping, to further displace and distribute the cement slurry 37 in the production pipe 211 and further out into the annulus 5. This ensures even more thorough and more effective cementing of the production pipe 211 and the annulus 5. As mentioned, such a displacement body (apparatus) is shown and described in NO 20120099, which corresponds to WO 2012/128644 A2.

Figure 6:
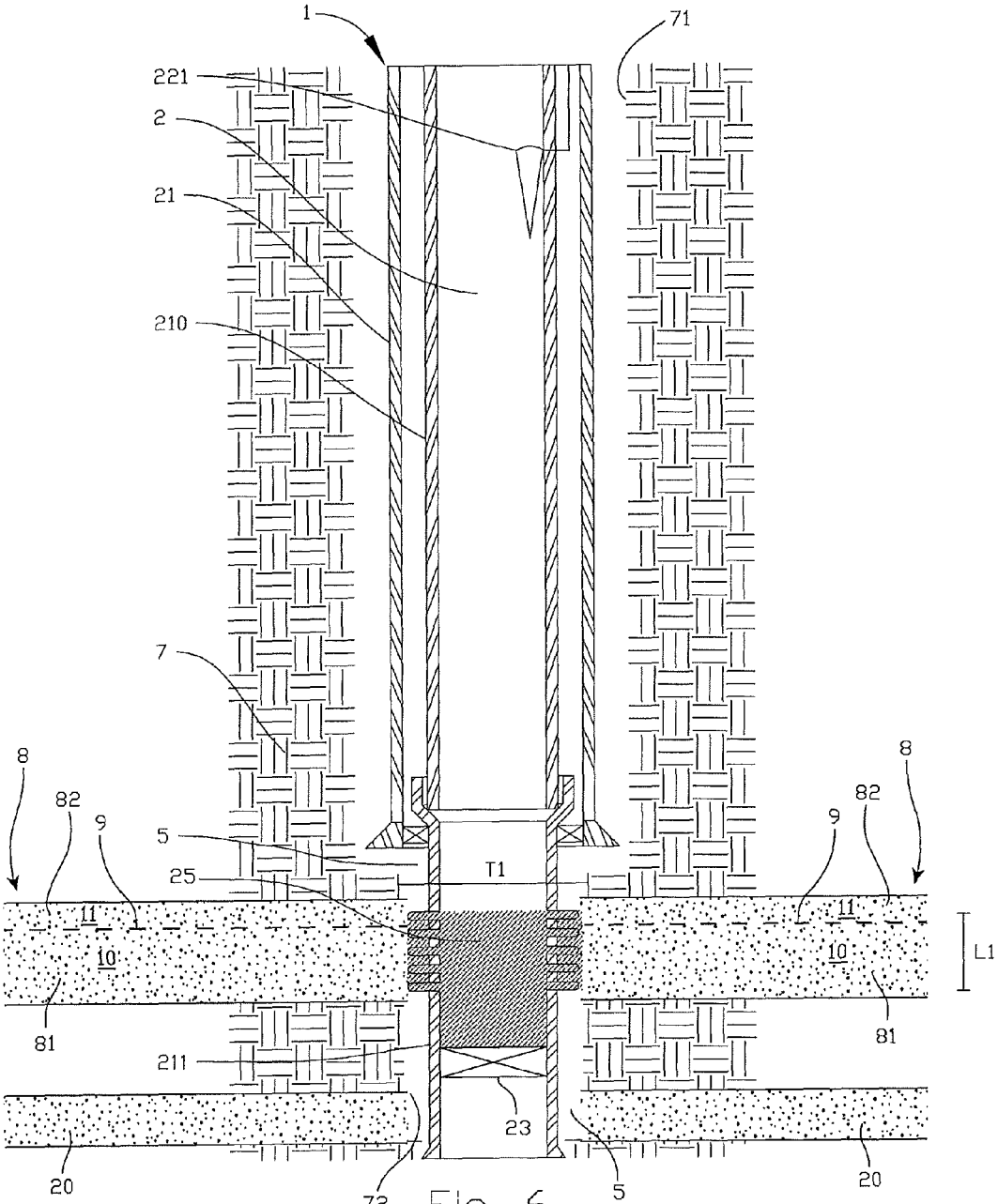

FIG. 6 shows the cement slurry 37 after having cured and set in the well 1 so as to form a plug 25 of cured cement. The cement plug 25 covers substantially a complete cross section T1 of the well 1 within the longitudinal section L1, and also a portion of the production pipe 211 down to the plug base 23.

Figure 7:
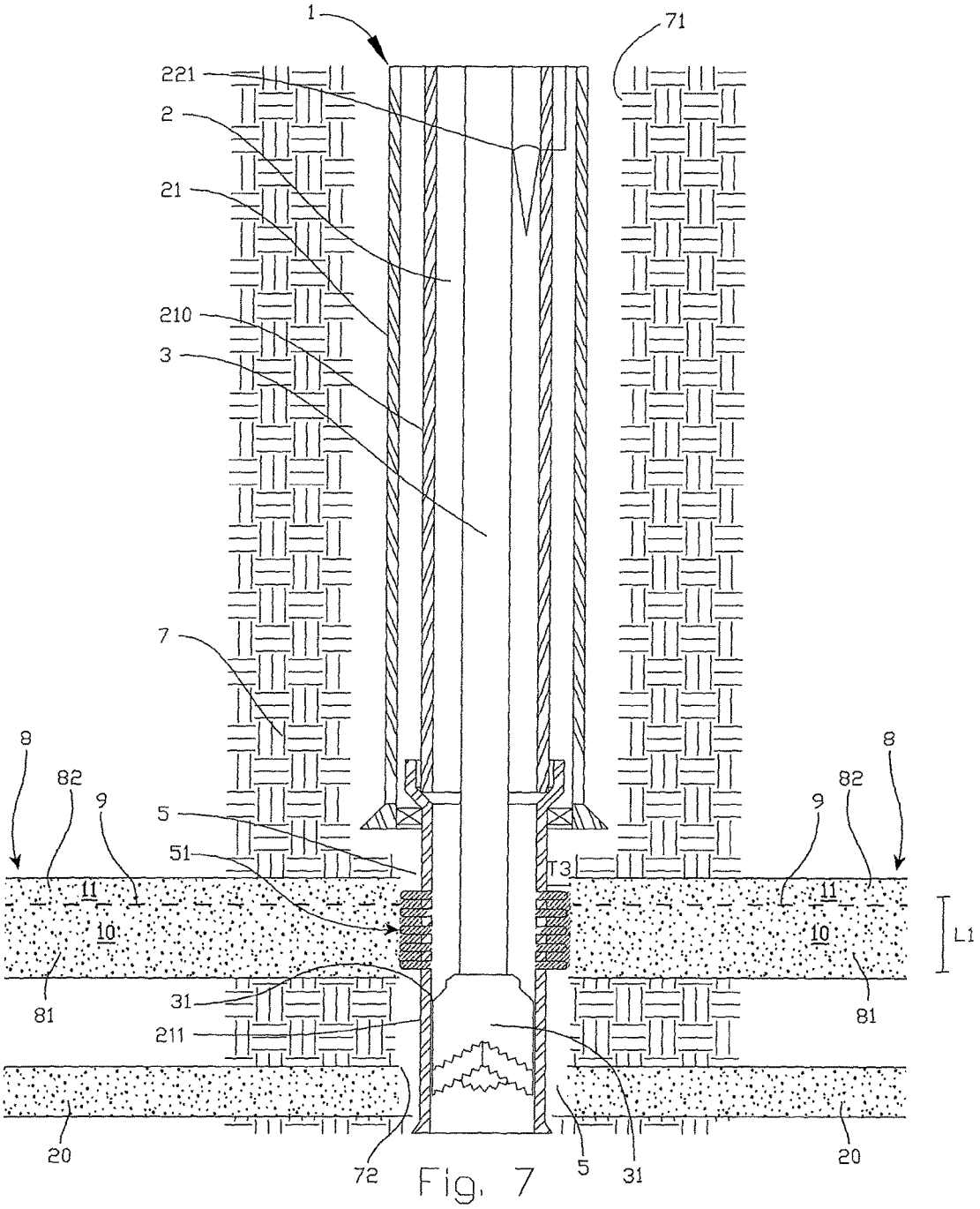

FIG. 7 shows the well 1 immediately after having drilled out a central, through-going portion of the cement plug 25 by means of a drilling tool 31.

Figure 8:
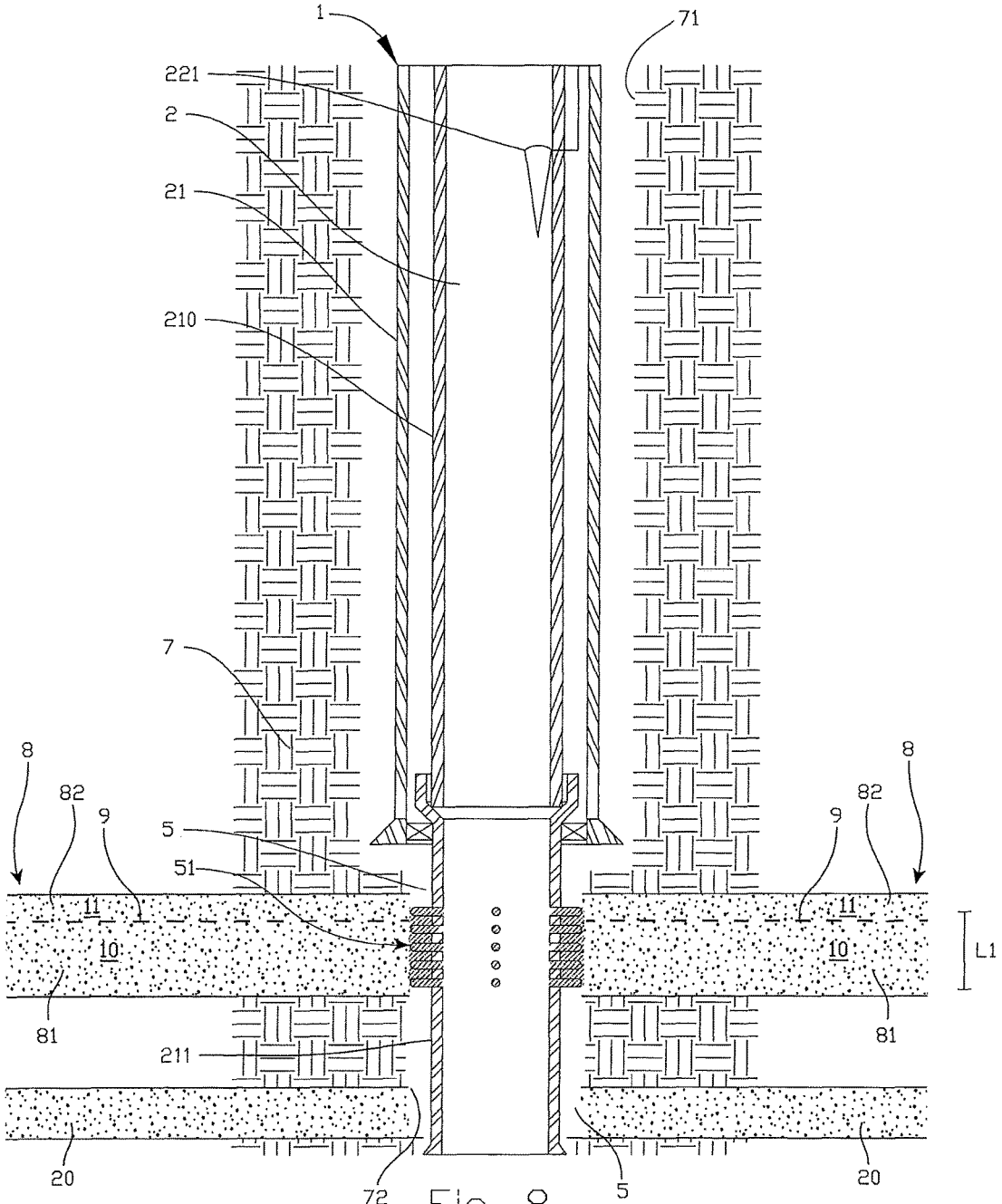

FIG. 8 shows the well 1 after having removed the drilling tool 31 from the well 1 so as to leave a remaining cross-sectional section T3 of the cement plug 25 in the annulus 5, and within the longitudinal section L1. The remaining cross-sectional section T3 of the cement plug 25 forms a barrier 51 between the production pipe 211 and the borehole wall 72 defining the reservoir 8. Thereby, the entire reservoir 8 is isolated from the rest of the well 1.

FIG. 9 shows the well 1 after having formed said new perforations 214 in the production pipe 211, and vis-à-vis the separate and deeper oil reservoir 20 in the well 1. As mentioned, the distance between the reservoirs 8 and 20 may be very large, commonly in the order of kilometers. The Figure also shows arrows indicating fluid flow from the oil reservoir 20 and into the production pipe 211 via the new perforations 214.

Figure 10:
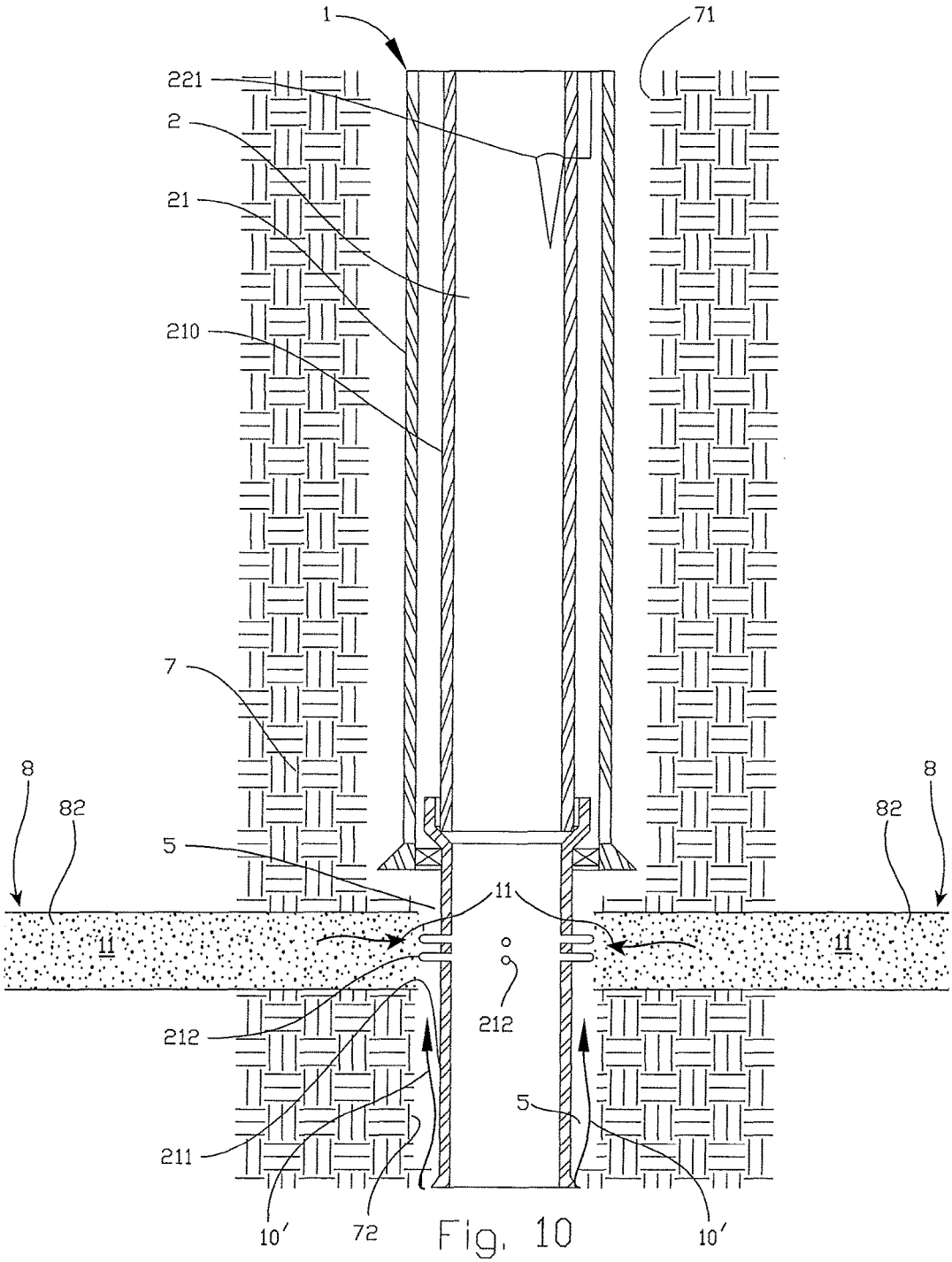
FIGS. 10-11 show, in a second embodiment, different stages of the method as used for isolation in another situation in a similar production well.
Figure 11:
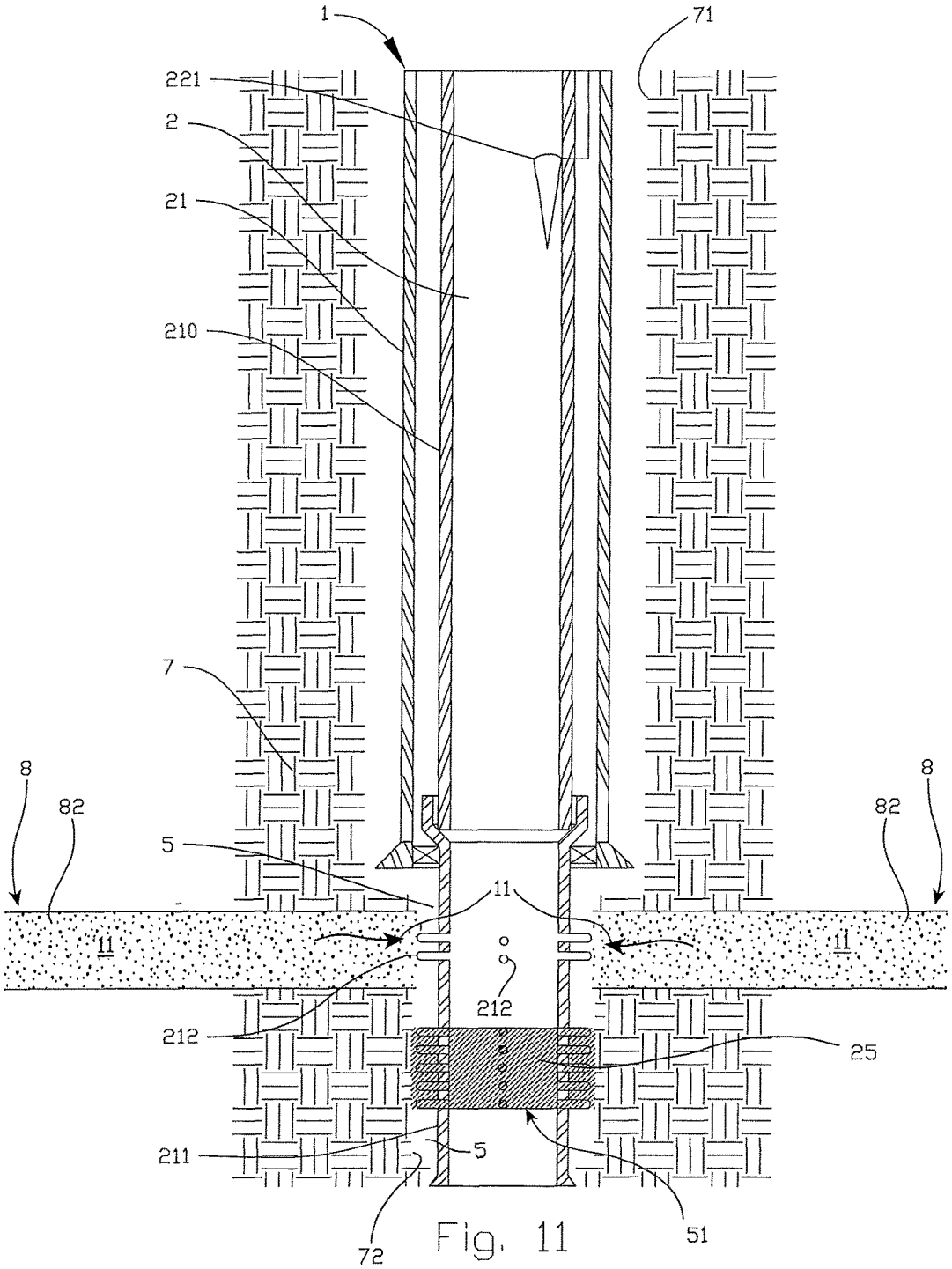

Reference is now made to said second embodiment of the method, which is illustrated in FIGS. 10 and 11.

FIG. 10 shows a similar production well 1, wherein water 10' from a deeper water zone (not shown) in the well 1 flows in an undesired manner in an annulus 5 behind a production pipe 211 and upward to perforations 212 formed directly vis-à-vis a producing, permeable oil zone 82 in a reservoir 8. Oil 11, which is flowing from the reservoir 8 and into the production pipe 211 via the perforations 212, is shown with arrows in the Figure. The flow of water 10' in the annulus 5 is also depicted with arrows in the Figure. The water 10' flows into the production pipe 211 via the perforations 212 and mixes into the production stream together with oil 11 from the reservoir 8. Oftentimes, the undesired water flow may be a result of a poor and/or difficult cementing job previously in the well 1. A need therefore exists for isolating the producing reservoar 8 and the perforations 212 from water flow in the annulus 5 and the deeper water zone in the well 1.

FIG. 11 shows the well 1 after having set a cement plug 25 in a plugging region below the reservoir 8 and the perforations 212 in the production pipe 211. The cement plug 25 has been formed and set in the same manner as described above with reference to FIGS. 4-6. Similar to the cross section T1 shown in FIG. 6 in the preceding embodiment, the plug 25 in this second embodiment also has been set across the complete cross section of the well 1 so as to form a barrier 51 in said plugging region of the well 1. By so doing, the reservoir 8 and the production stream therefrom are completely isolated from said deeper water zone in the well 1, and thus from water flow from this water zone.

The invention claimed is:

1. A method of isolating and preventing fluid communication with a permeable zone in a subterranean well, wherein the well, at least in a portion where the isolation is to be carried out, is provided with a pipe body, wherein the method comprises:

(A) lowering a perforation tool into the pipe body onto a longitudinal section of the well where the isolation is to be carried out;

(B) with the perforation tool, forming holes in the pipe body along the longitudinal section;

(C) with a flushing tool attached to a lower portion of a flow-through pipe string, and lowered into the pipe body onto the longitudinal section, pumping a flushing fluid down through the pipe string, out through at least one flow-through outlet in a first section of the flushing tool configured to discharge the flushing fluid, into the pipe body and further out, via the holes in the pipe body, into an annulus between an outside of the pipe body and a surrounding well body, thereby cleaning the annulus;

wherein at least one of the at least one flow-through outlet in the first section of the flushing tool is angled non-perpendicularly relative to a longitudinal axis of the flushing tool such that a corresponding discharge jet will consequently be discharged from the first section of the flushing tool at an angle non-perpendicular to the longitudinal axis of the flushing tool and caused to enter into the annulus having followed a substantially linear path from the outlet to the annulus;

(D) pumping a fluidized plugging material down through the pipe string, out through at least one flow-through outlet in a second section of the flushing tool integral with the first section and configured to discharge the fluidized plugging material, into the pipe body and further out into the annulus via the holes in the pipe body as the first section of the flushing tool remains integral with the second section of the flushing tool; and (E) placing the fluidized plugging material along the longitudinal section of the well, after which the plugging material forms a plug covering substantially a complete cross section of the well, whereby the plug fills an inside of the pipe body and the annulus between the outside of the pipe body and the surrounding well body.

2. The method according to claim 1, wherein the surrounding well body is comprised of a borehole wall.

3. The method according to claim 1, wherein the surrounding well body is comprised of another and larger pipe body than the pipe body, whereby a pipe-in-pipe constellation is present within this region of the well.

4. The method according to claim 1, wherein the pipe body is comprised of a tubular production string.

5. The method according to claim 1, wherein the pipe body is comprised of a tubular injection string.

6. The method according to claim 1, wherein the method comprises, before (D), disposing and anchoring a plug base in the pipe body, and below the longitudinal section of the well.

7. The method according to claim 1, wherein the at least one of the at least one flow-through outlet in the first section of the flushing tool is angled within ±80° of a plane being perpendicular to the longitudinal axis of the flushing tool, whereby the corresponding discharge jet from the first section of the flushing tool is also distributed within ±80° of said plane.

8. The method according to claim 1, wherein each flow-through outlet in the flushing tool is provided with a nozzle.

9. The method according to claim 1, wherein (C) comprises rotating the pipe string whilst flushing.

10. The method according to claim 1, wherein (C) comprises moving the pipe string in a reciprocating motion whilst flushing.

11. The method according to claim 1, further comprising adding an abrasive agent to the flushing fluid.

12. The method according to claim 11, further comprising adding an abrasive agent to the flushing fluid in an amount corresponding to between 0.05 weight percent and 1.00 weight percent.

13. The method according to claim 11, wherein the abrasive agent comprises sand particles.

14. The method according to claim 1, further comprising discharging the flushing fluid from the at least one outlet in the first section of the flushing tool as a substantially rotation-free discharge jet.

15. The method according to claim 1, wherein the fluidized plugging material comprises cement slurry.

16. The method according to claim 1, wherein the fluidized plugging material comprises a fluidized particulate mass.

17. The method according to claim 1, wherein the flushing fluid comprises drilling mud.

18. The method according to claim 1, further comprising using a displacement body having a helical exterior, wherein the displacement body is coupled to the pipe string and is moveable within the pipe body to further displace and distribute the fluidized plugging material in the pipe body and further out into the annulus.

19. The method according to claim 1, further comprising, before (A):

connecting the perforation tool and the flushing tool into an assembly thereof; and connecting the assembly to said lower portion of the pipe string;

thereby carrying out the perforation (A, B) and the flushing (C) in one and the same trip down into the well.

20. The method according to claim 1, further comprising releasably connecting a lower end portion of the flushing tool to the perforation tool; and separating the perforation tool from the flushing tool and leaving it in the well after (B).

21. The method according to claim 1, further comprising, before (C):

lowering the perforation tool into the pipe body and forming said holes in the pipe body along the longitudinal section of the well;

pulling the perforation tool out of the well; and attaching the flushing tool to the lower portion of the pipe string for subsequent execution of (C)-(E);

thereby carrying out the perforation (A, B) and the flushing (C) in separate trips down into the well.

22. The method according to claim 1, wherein the longitudinal section is located vis-à-vis a permeable reservoir zone, thereby forming the plug vis-à-vis the permeable reservoir zone.

23. The method according to claim 22, wherein the permeable reservoir zone comprises an oil-water contact.

24. The method according to claim 1, wherein the longitudinal section is located vis-à-vis a portion of the annulus where crossflow exists, thereby forming the plug vis-à-vis this crossflow portion of the annulus.

25. The method according to claim 1, further comprising, after (E), forming, with a perforation tool, at least one hole in the pipe body along a portion of the well located above the longitudinal section where the plug has been set and covers substantially the complete cross section of the well.

26. The method according to claim 1, further comprising, after (E), (F) drilling out a central, through-going portion of the plug in the pipe body, whereby at least a cross-sectional section of the plug remains in the annulus outside the pipe body.

27. The method according to claim 26, further comprising, after (F), forming, with a perforation tool, at least one hole in the pipe body along a portion of the well located below the longitudinal section where the plug has been set and drilled out.

28. The method according to claim 1, wherein the at least one non-perpendicular outlet in the first section of the flushing tool comprises several non-perpendicular outlets, wherein at least one of the several non-perpendicular outlets in the first section is angled at a first angle relative to the longitudinal axis of the flushing tool, and wherein at least one other of the several non-perpendicular outlets in the first section is angled at a second angle different than the first angle relative to the longitudinal axis of the flushing tool.

29. The method according to claim 1, wherein the at least one non-perpendicular outlet in the first section of the flushing tool comprises several non-perpendicular outlets, wherein at least one of the several non-perpendicular outlets in the first section is a downward outlet angled downwardly and non-perpendicularly relative to the longitudinal axis of the flushing tool, and wherein at least one other of the several non-perpendicular outlets in the first section is an upward outlet angled upwardly and non-perpendicularly relative to the longitudinal axis of the flushing tool.

30. The method according to claim 1, wherein the at least one outlet in the second section of the flushing tool is larger than the at least one outlet in the first section of the flushing tool.

* * * * *